United States Patent [19]

Kennedy

[11] 4,130,122

[45] Dec. 19, 1978

[54] HAIR CURLER OPERATING DEVICE

[76] Inventor: David J. Kennedy, R.D. #4, York, Pa. 17404

[21] Appl. No.: 883,140

[22] Filed: Mar. 3, 1978

[51] Int. Cl.[2] ..... A45D 2/12

[52] U.S. Cl. ..... 132/34 R

[58] Field of Search ..... 132/34 R, 40, 42, 37 R; 219/222, 225; 15/26

[56] References Cited

U.S. PATENT DOCUMENTS

| | | | |
|---|---|---|---|
| 563,784 | 7/1896 | Morley | 132/34 R |
| 1,630,078 | 5/1927 | Smith | 132/34 R |
| 2,134,486 | 10/1938 | Leland | 132/34 R |
| 2,573,456 | 10/1951 | Kutzler et al. | 132/34 R |
| 2,797,692 | 7/1957 | Lenzi | 132/34 R |
| 4,024,375 | 5/1977 | Olesen | 132/34 R |

*Primary Examiner*—G.E. McNeill
*Attorney, Agent, or Firm*—C. Hercus Just

[57] ABSTRACT

A hand-operated device comprising a handle having a rotatable shaft supported by the handle and one end projecting beyond one end of the handle and having means to support removably thereon a conventional hair curler. A spool is affixed to the shaft and has a flexible cord-like member coiled therearound, whereby when the outer end of said member is pulled, the shaft and curler thereon is rotated for purposes of winding hair upon the curler. For purposes of restoring the cord-like member to coiled condition, a circular friction member is mounted upon the shaft and is adapted to be rolled along a suitable surface in one direction to coil the cord-like member upon the spool to arrange the same in starting position.

6 Claims, 5 Drawing Figures

HAIR CURLER OPERATING DEVICE

BACKGROUND OF THE INVENTION

In view of the fact that winding hair upon hair curlers has been a problem sought to be solved in various ways for many years, there are many patents disclosing an extensive number of devices for rotating hair curlers and thereby circumvent the need to wind hair upon the curlers entirely by hand operation. Among the prior patents to accomplish such winding operation, mechanical devices to effect the rotation of the curlers have been achieved by rack and pinion drive means, reversible electric motors, ratchet-type lever and spring return means, spiral drive shaft and follower movable axially therealong, egg beater gearing, twisted rubberband, a coiled flexible member on a pulley and spring actuating means therefor, and also a coiled string wound around a spool but rewinding the cord upon the spool is accomplished only manually.

It is the principal object of the present invention to utilize a coiled string-like member wound around a spool but provide simple and effective means for rapidly recoiling the flexible string-like member around the spool to place the same in initial position for operation, details of said structure being set forth below.

SUMMARY OF THE INVENTION

It is the principal object of the present invention to provide an elongated handle adapted to be held in one hand of the operator and provided with a rotatable shaft projecting from one end of the handle and having means thereon to support in readily removable manner, a conventional hair curler, the shaft also having a spool mounted thereon adjacent the handle and a circular friction member being disposed adjacent said one end of the handle and connected to the rotatable shaft for engagement with a suitable surface, whereby when the friction member is rolled along said surface, the string-like member will be recoiled around the spool.

It is another object of the invention to preferably mount the spool in enclosed manner within the end of the handle nearest the friction member and said handle having an opening through which the string is movable, the outer end of the string preferably having an enlarged member thereon, larger than the diameter of the opening so that when the string-like member is completely coiled upon the spool, the enlarged end of the flexible string-like member is available to be pulled and also prevents drawing said outer end of the string-like member into the interior of the handle at the completion of the winding thereof.

A further object of the invention is to employ a conventional O-ring as the circular friction member which is mounted upon a suitable hub connected to the rotatable shaft immediately adjacent said one end of the handle.

Details of the foregoing objects and of the invention, as well as other objects thereof, are set forth in the following specification and illustrated in the accompanying drawing comprising a part thereof.

DETAILED DESCRIPTION OF THE DRAWING

DETAILED DESCRIPTION

Figure 1:
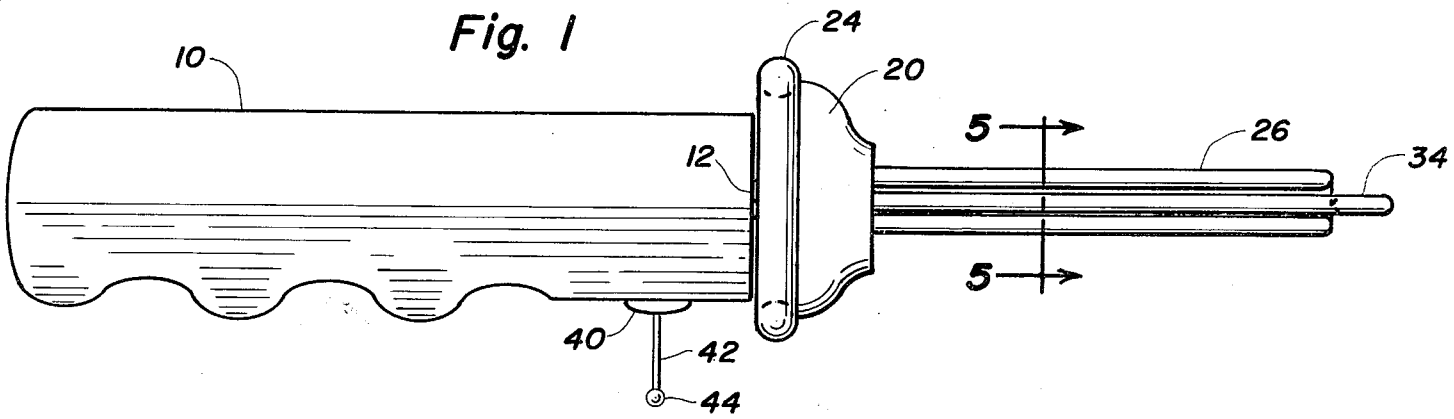
FIG. 1 is a side elevation of a preferred embodiment of the invention.
Figure 2:
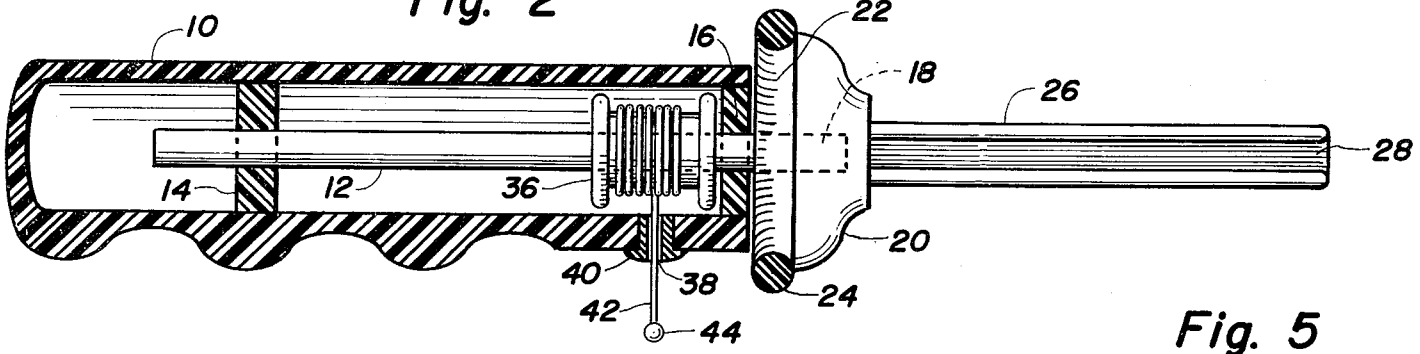
FIG. 2 is a longitudinal sectional view of the handle of the device shown in FIG. 1 and illustrating the contents of the handle, according to the preferred embodiment of the invention.

Referring to FIGS. 1 and 2, an elongated handle 10 is provided which preferably is hollow, as shown in FIG. 32, and one end thereof is initially open for the reception of contents to be described below. It will be seen that the handle 10 preferably has a contour adapted to readily be held in one hand of an operator in a comfortable manner. If desired, the handle may be molded from any suitable material, such as appropriate plastics, or otherwise.

An elongated shaft 12 extends longitudinally within the interior of the hollow handle 10, as shown in FIG. 2, there being preferably a plurality of bearings 14 and 16 having suitable bearing openings to receive the shaft 12, the bearing 14 being axially spaced upon the shaft 12 within the interior of handle 10 a substantial distance from the bearing 16, which is adjacent the initially open end of handle 10. If desired, the bearings may be frictionally inserted within the hollow interior of the handle 10 but other means for mounting the bearings therein may be employed.

One end 18 of shaft 12 projects beyond said one end of the handle 10 and also beyond the bearing 16 for purposes of supporting a suitable hub 20, which may be molded from any suitable material or formed from wood or the like, one end of said hub having a circular channel 22 formed therein to receive a circular friction member comprising preferably a rubber O-ring 24, the outer diameter of which preferably is at least slightly greater than that of the handle 10, whereby said friction member 24 may be engaged upon a suitable surface and rolled therealong for purposes to be described. The member 24 is preferably tightly seated within the circular channel 22.

Figure 5:
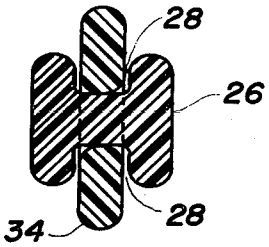
FIG. 5 is an enlarged transverse sectional view of the curler and supporting means therefor as seen on the line 5—5 of FIG. 1.
Figure 4:
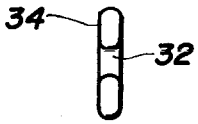
FIG. 4 is an end view of the adaptor shown in FIG. 3.
Figure 3:
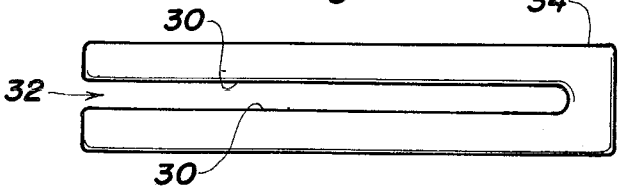
FIG. 3 is a side elevation of an adaptor attachable to the rotatable shank to accommodate a larger curler than the shank per se.

The forward end of the hub 20 also has an elongated supporting shank 26 which may be formed integrally with the hub 20, if desired, and formed from the same material, such as appropriate plastics. Preferably, the shank 26 is uniform throughout its length and, in cross-section, it is of a suitable cross-sectional dimension to readily slidably receive and support a hair curler of a certain diameter of any desired type. The specifically shown exemplary shank 26, as best shown in FIG. 5, is provided with a pair of opposing slots 28 for purposes of slidably receiving the opposing surfaces 30 of an elongated slot 32 formed in a simple, flat, blade-type adapter of greater cross-sectional dimension than shank 26 for use with a larger diameter of hair curler than shank 26. It is to be understood that the specifically shown shank 26 and adapter 34 are examples of a number of different shapes and types which may be provided for use with the curling device comprising the invention to accommodate various sizes of curlers and supporting the same in readily, slidably removable manner, whereby upon the end of a curling function, the curler may be slidably removed from the shank 26 or adapter 34 and the operating device then is reconditioned to starting condition in the manner described below.

Manual rotation of the shaft 12 and correspondingly, the shank 26 and any curler supported thereon, is accomplished by means of a spool 36, which may be formed from any appropriate material, such as plastics, and press-fitted or otherwise secured to the shaft 12 in any appropriate manner, preferably also being enclosed within the interior of the hollow handle 10, such as illustrated in exemplary manner in FIG. 2. The handle is provided with an opening 38 which may be lined with a suitable ferrule 40 and through which the outer end of a flexible cord-like member 42 extends. Preferably, an appropriate enlargement 44 is connected to the outer end of the flexible member 42, such as a bead or otherwise. Said enlargement prevents the outer end of the cord being wound upon the spool 36 and also makes the outer end readily accessible for pulling in order that uncoiling of the member 42 from the spool 36 will rotate the shaft 12 and shank 26 in a desired direction, depending upon the direction in which the member 42 is coiled upon the spool 36.

In operation, a curler of desired size is mounted upon the shank 26 and/or adapter 34 and the initial coiling of a hank of hair is started upon the curler mounted thereon, following which the outer end of the flexible member 42 is pulled while moving the shank 26 and/or adapter 34 toward the head of the user and thereby coil the hank of hair completely upon the curler. The coiled hair is then suitably secured such as by using a rubber-band, conventional hair pin, or otherwise, followed by slidably removing the shank 26 and/or adapter 34 from the curler.

To restore the flexible member 42 to coiled condition upon the spool 36, it is only necessary to quickly move the friction member 24 along a suitable surface, such as a table or counter and thereby rapidly recoil the flexible member 42 upon the spool 36, preferably to the full extent in which the enlargement 44 will abut the ferrule 40, whereupon the operating device is restored to initial condition and is ready to have another curler mounted thereon for coiling of hair about the same.

From the foregoing, it will be seen that the present invention provides a simple but effective means for rotating a curler incident to forming a coiled hank of hair thereon, simply by pulling the outer end of the flexible member 42 to uncoil the same and thereby rotate the spool 36 and the curler upon the supporting shank 26 while moving the shank and curler toward the head of the user. At the completion of the curling operation, the device is readily removed from the curler of the completed curl and a new one is quickly installed thereon for repeat of the coiling operation after first recoiling the flexible member 42 upon the spool 36 in the manner described above.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A device to support a hair curler unit and rotate it to coil hair upon the curler comprising in combination, an elongated handle, a shaft rotatably supported at one end within bearings within said handle, and the opposite end projecting beyond one end of said handle, means on said opposite end of said shaft removably receiving a hair curler for rotation thereof by said shaft, a spool connected to said shaft adjacent one end of said handle, a flexible cord-like member coilable around said spool and operable to rotate said spool and shaft when said cord-like member is pulled to uncoil it from said spool, and a circular friction member fixed to said shaft and adapted to be rolled upon a surface while manually moving said handle relative to said surface to rotate said spool in a direction to coil said cord-like member upon said spool after the uncoiling of the same therefrom to rotate said shaft in a direction to coil hair upon a curler mounted upon said opposite end of said shaft.

2. The device according to claim 1 in which at least a portion of said handle is hollow and said spool being mounted upon said shaft within said hollow portion of said handle and said handle having a hole through which said cord-like member extends, the outer end of said member having an enlargement thereon of greater size than said hole to prevent said outer end from passing into said hollow portion of said handle.

3. The device according to claim 2 in which said handle is provided on the interior of said hollow portion with a plurality of bearings spaced axially along said shaft to support the same for rotation relative to said handle.

4. The device according to claim 1 in which said circular friction member comprises an O-ring surrounding a hub fixed to said shaft adjacent said one end of said handle and said O-ring having a larger outer diameter than said handle.

5. The device according to claim 1 in which said means on said opposite end of said shaft to receive a hair curler comprises an elongated shank of uniform cross-section to accommodate a hair curler of a predetermined diameter and said shank being shaped to slidably receive an adapter of greater cross-sectional dimension than said shank to accommodate a hair curler of greater diameter than those to be received upon said shank.

6. The device according to claim 5 in which said shank has a pair of elongated grooves in opposite sides thereof and said adapter is slotted to slidably receive said shank with the edges of said adapter along said slot being slidably disposed respectively within said slots frictionally.

* * * * *